US006370082B1

(12) United States Patent
Gardner et al.

(10) Patent No.: US 6,370,082 B1
(45) Date of Patent: Apr. 9, 2002

(54) ACOUSTIC TELEMETRY SYSTEM WITH DRILLING NOISE CANCELLATION

(75) Inventors: Wallace R. Gardner; Vimal V. Shah; John W. Minear, all of Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/332,641

(22) Filed: Jun. 14, 1999

(51) Int. Cl.[7] ..... G01V 1/40

(52) U.S. Cl. ..... 367/82; 367/83; 340/854.4; 375/229

(58) Field of Search ..... 367/82, 83; 375/229, 375/230, 232; 340/854.4

(56) References Cited

U.S. PATENT DOCUMENTS

| | | | | |
|---|---|---|---|---|
| 2,810,546 | A | 10/1957 | Eaton et al. | 367/82 |
| 3,588,804 | A | 6/1971 | Fort | 367/82 |
| 3,790,930 | A | 2/1974 | Lamel et al. | 340/18 |
| 3,813,656 | A | 5/1974 | Fowler | 340/18 |
| 4,254,481 | A | 3/1981 | Smither et al. | 367/82 |
| 4,282,588 | A | 8/1981 | Chanson et al. | 367/82 |
| 4,283,779 | A | 8/1981 | Lamel | 367/82 |
| 4,293,936 | A | 10/1981 | Cox et al. | 367/82 |
| 4,302,826 | A | 11/1981 | Kent et al. | 367/82 |
| 4,314,365 | A | 2/1982 | Petersen et al. | 367/82 |
| 4,320,473 | A | 3/1982 | Smither et al. | 367/82 |
| 4,562,559 | A | 12/1985 | Sharp et al. | 367/82 |
| 4,878,206 | A | 10/1989 | Grosso et al. | 367/83 |
| 5,130,951 | A | 7/1992 | Kingman | 367/82 |
| 5,151,882 | A | 9/1992 | Kingman | 367/82 |
| 5,289,354 | A | 2/1994 | Clayer et al. | 367/82 |
| 5,321,981 | A | 6/1994 | Macpherson | 73/151 |

FOREIGN PATENT DOCUMENTS

| | | | |
|---|---|---|---|
| EP | 0919696 | 6/1999 | |
| GB | 2249852 | 5/1992 | E21B/47/12 |
| WO | 8910572 | 11/1989 | |
| WO | 9848140 | 10/1998 | |

OTHER PUBLICATIONS

*Acoustical Properties of Drill Strings*, Sandia Report, Jul. 1988, Sandia National Laboratories.

*Acoustic Telemetry System With Drilling Noise Cancellation*, PCT Application No. PCT/US00/16184, International Filing Date of Jun. 13, 2000 by Wallace R. Gardner et al.

*Primary Examiner*—Michael Horabik
*Assistant Examiner*—Albert K. Wong
(74) *Attorney, Agent, or Firm*—Conley, Rose & Tayon, P.C.

(57) ABSTRACT

An acoustic telemetry system is disclosed that reduces any through-drillstring drilling noise which contaminates a through-drillstring telemetry signal. Normal filtering operations are provided to remove noise outside the frequency band of interest, and reference signal filtering operations are provided to reduce the in-band noise, thereby enhancing the telemetry system's data rate and reliability. In one embodiment, the acoustic telemetry system includes a transmitter and a receiver. The transmitter induces an acoustic information signal that propagates along the tubing string. Existing noise in the tubing string contaminates the information signal. The receiver is provided with sensors for measuring the corrupted information signal and a reference signal that is indicative of the noise present in the measured information signal. The receiver uses a filter to convert the reference signal into an estimate of the information signal corruption, and a summing element to subtract the estimate from the reference signal to produce an information signal with reduced corruption. In a preferred embodiment, the information signal is propagated in an axial transmission mode, and the noise in the torsional mode is used as the reference signal for reducing noise the information signal picks up in the axial mode.

18 Claims, 2 Drawing Sheets

FIG. 1
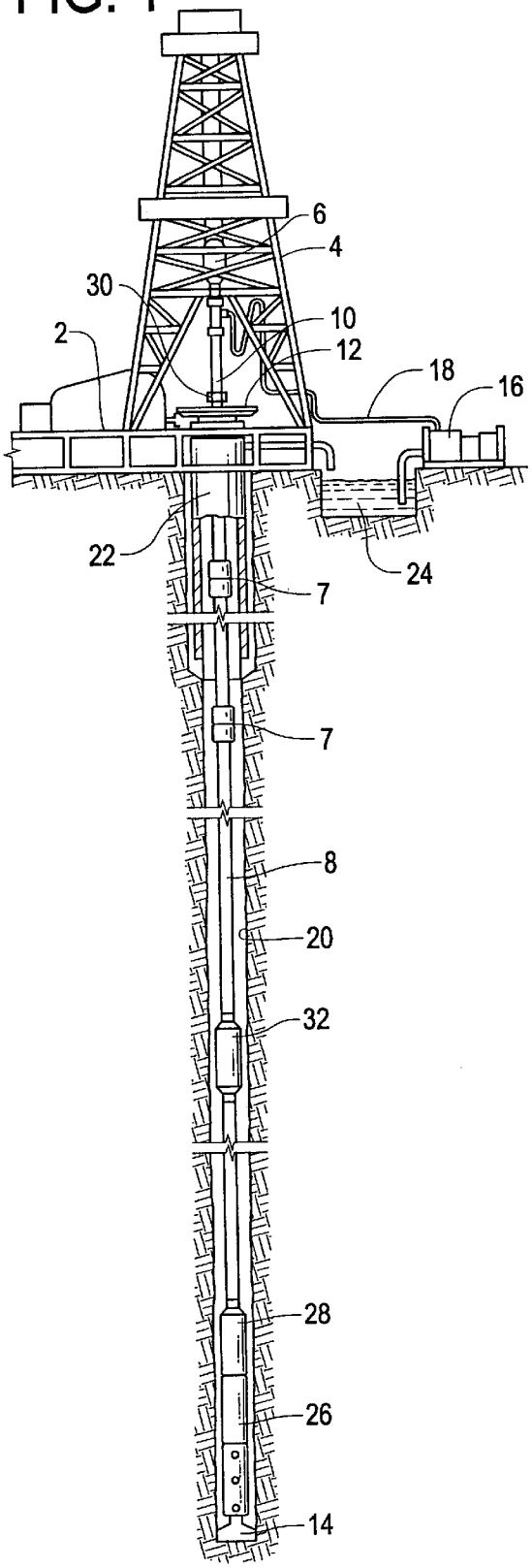
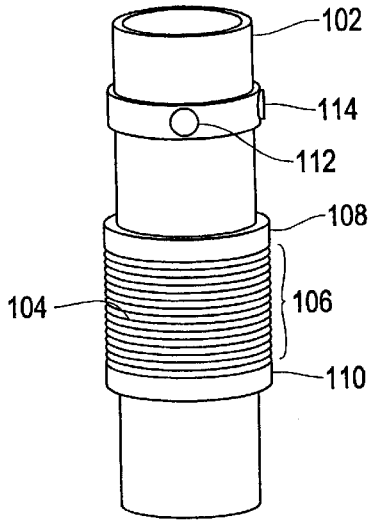
FIG. 2
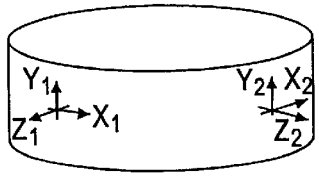
FIG. 6A
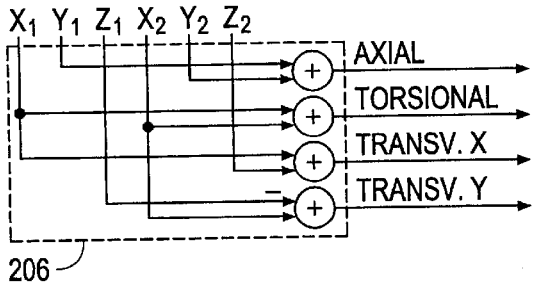
FIG. 6B

ACOUSTIC TELEMETRY SYSTEM WITH DRILLING NOISE CANCELLATION

BACKGROUND OF THE INVENTION

1. Field of the Invention

The present invention relates to a telemetry system for transmitting data from a downhole drilling assembly to the surface of a well during drilling operations. More particularly, the present invention relates to a system and method for improved acoustic signaling through a drill string.

2. Description of the Related Art

Modern petroleum drilling and production operations demand a great quantity of information relating to parameters and conditions downhole. Such information typically includes characteristics of the earth formations traversed by the wellbore, along with data relating to the size and configuration of the borehole itself. The collection of information relating to conditions downhole, which commonly is referred to as "logging", can be performed by several methods.

In conventional oil well wireline logging, a probe or "sonde" housing formation sensors is lowered into the borehole after some or all of the well has been drilled, and is used to determine certain characteristics of the formations traversed by the borehole. The upper end of the sonde is attached to a conductive wireline that suspends the sonde in the borehole. Power is transmitted to the sensors and instrumentation in the sonde through the conductive wireline. Similarly, the instrumentation in the sonde communicates information to the surface by electrical signals transmitted through the wireline.

The problem with obtaining downhole measurements via wireline is that the drilling assembly must be removed or "tripped" from the drilled borehole before the desired borehole information can be obtained. This can be both time-consuming and extremely costly, especially in situations where a substantial portion of the well has been drilled. In this situation, thousands of feet of tubing may need to be removed and stacked on the platform (if offshore). Typically, drilling rigs are rented by the day at a substantial cost. Consequently, the cost of drilling a well is directly proportional to the time required to complete the drilling process. Removing thousands of feet of tubing to insert a wireline logging tool can be an expensive proposition.

As a result, there has been an increased emphasis on the collection of data during the drilling process. Collecting and processing data during the drilling process eliminates the necessity of removing or tripping the drilling assembly to insert a wireline logging tool. It consequently allows the driller to make accurate modifications or corrections as needed to optimize performance while minimizing down time. Designs for measuring conditions downhole including the movement and location of the drilling assembly contemporaneously with the drilling of the well have come to be known as "measurement-while-drilling" techniques, or "MWD". Similar techniques, concentrating more on the measurement of formation parameters, commonly have been referred to as "logging while drilling" techniques, or "LWD". While distinctions between MWD and LWD may exist, the terms MWD and LWD often are used interchangeably. For the purposes of this disclosure, the term MWD will be used with the understanding that this term encompasses both the collection of formation parameters and the collection of information relating to the movement and position of the drilling assembly.

When oil wells or other boreholes are being drilled, it is frequently necessary or desirable to determine the direction and inclination of the drill bit and downhole motor so that the assembly can be steered in the correct direction. Additionally, information may be required concerning the nature of the strata being drilled, such as the formation's resistivity, porosity, density and its measure of gamma radiation. It is also frequently desirable to know other downhole parameters, such as the temperature and the pressure at the base of the borehole, for example. Once this data is gathered at the bottom of the borehole, it is typically transmitted to the surface for use and analysis by the driller.

Sensors or transducers typically are located at the lower end of the drill string in LWD systems. While drilling is in progress these sensors continuously or intermittently monitor predetermined drilling parameters and formation data and transmit the information to a surface detector by some form of telemetry. Typically, the downhole sensors employed in MWD applications are positioned in a cylindrical drill collar that is positioned close to the drill bit. The MWD system then employs a system of telemetry in which the data acquired by the sensors is transmitted to a receiver located on the surface. There are a number of telemetry systems in the prior art which seek to transmit information regarding downhole parameters up to the surface without requiring the use of a wireline tool. Of these, the mud pulse system is one of the most widely used telemetry systems for MWD applications.

The mud pulse system of telemetry creates "acoustic" pressure signals in the drilling fluid that is circulated under pressure through the drill string during drilling operations. The information that is acquired by the downhole sensors is transmitted by suitably timing the formation of pressure pulses in the mud stream. The information is received and decoded by a pressure transducer and computer at the surface.

In a mud pressure pulse system, the drilling mud pressure in the drill string is modulated by means of a valve and control mechanism, generally termed a pulser or mud pulser. The pulser is usually mounted in a specially adapted drill collar positioned above the drill bit. The generated pressure pulse travels up the mud column inside the drill string at the velocity of sound in the mud. Depending on the type of drilling fluid used, the velocity may vary between approximately 3000 and 5000 feet per second. The rate of transmission of data, however, is relatively slow due to pulse spreading, distortion, attenuation, modulation rate limitations, and other disruptive forces, such as the ambient noise in the drill string. A typical pulse rate is on the order of a pulse per second (1 Hz).

Given the recent developments in sensing and steering technologies available to the driller, the amount of data that can be conveyed to the surface in a timely manner at 1 bit per second is sorely inadequate. As one method for increasing the rate of transmission of data, it has been proposed to transmit the data using vibrations in the tubing wall of the drill string rather than depending on pressure pulses in the drilling fluid. However, the presence of existing vibrations in the drill string due to the drilling process severely hinders the detection of signals transmitted in this manner.

SUMMARY OF THE INVENTION

Accordingly, there is disclosed herein a downhole acoustic telemetry system that transmits a signal to the surface of the well. The acoustic telemetry system reduces through-drillstring drilling noise that contaminates the through-drillstring telemetry signal. Normal filtering operations operate to remove noise outside the frequency band of interest, and reference signal filtering operations are provided to reduce the in-band noise, thereby enhancing the telemetry system's data rate and reliability. In one embodiment, the acoustic telemetry system includes a transmitter and a receiver. The transmitter induces an acoustic information signal that propagates along the tubing string in a primary propagation mode (e.g. axial mode). Existing noise in the tubing string contaminates the information signal. The receiver includes sensors that measure the corrupted information signal and a reference signal that is indicative of the noise present in the measured information signal. The reference signal is taken from another acoustic propagation mode (e.g. torsional mode). Because a relationship exists between the reference signal and the corruption in the information signal, the receiver filters the reference signal to produce an estimate of the information signal corruption, and subtracts the estimate from the reference signal to produce an information signal with reduced corruption. In a preferred embodiment, the information signal is propagated in an axial transmission mode, and the noise in the torsional mode is used as the reference signal for reducing noise the information signal picks up in the axial mode.

BRIEF DESCRIPTION OF THE DRAWINGS

A better understanding of the present invention can be obtained when the following detailed description of the preferred embodiment is considered in conjunction with the following drawings, in which:

FIG. 1 is a schematic view of an oil well in which an acoustic telemetry system may be employed;

FIG. 2 is a view of an acoustic transmitter and an acoustic receiver;

FIG. 6A is a illustrative view of the relative orientation of various sensor axes; and FIG. 6B is a functional block diagram of one geometrical combining module embodiment.

Figure 3:
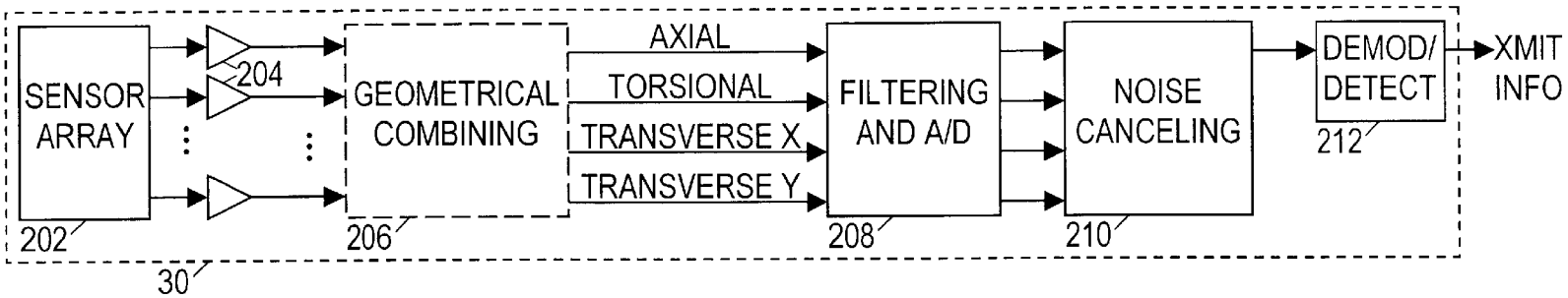
FIG. 3 is a functional block diagram of an acoustic receiver.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENT

Turning now to the figures, FIG. 1 shows a well during drilling operations. A drilling platform 2 is equipped with a derrick 4 that supports a hoist 6. Drilling of oil and gas wells is carried out by a string of drill pipes connected together by "tool" joints 7 so as to form a drill string 8. The hoist 6 suspends a kelly 10 that is used to lower the drill string 8 through rotary table 12. Connected to the lower end of the drill string 8 is a drill bit 14. The bit 14 is rotated and drilling accomplished by rotating the drill string 8, by use of a downhole motor near the drill bit, or by both methods. Drilling fluid, termed mud, is pumped by mud recirculation equipment 16 through supply pipe 18, through drilling kelly 10, and down through the drill string 8 at high pressures and volumes (such as 3000 p.s.i. at flow rates of up to 1400 gallons per minute) to emerge through nozzles or jets in the drill bit 14. The mud then travels back up the hole via the annulus formed between the exterior of the drill string 8 and the borehole wall 20, through the blowout preventer 22, and into a mud pit 24 on the surface. On the surface, the drilling mud is cleaned and then recirculated by recirculation equipment 16. The drilling mud is used to cool the drill bit 14, to carry cuttings from the base of the bore to the surface, and to balance the hydrostatic pressure in the rock formations.

Downhole sensors 26 are coupled to an acoustic telemetry transmitter 28 that transmits telemetry signals in the form of acoustic vibrations in the tubing wall of drill string 8. An acoustic telemetry receiver 30 is coupled to the kelly 10 to receive transmitted telemetry signals. One or more repeater modules 32 may be provided along the drill string to receive and retransmit the telemetry signals. The repeater modules 32 include both an acoustic telemetry receiver and an acoustic telemetry transmitter configured similarly to receiver 30 and the transmitter 28.

For the purposes of illustration, FIG. 2 shows a repeater module 32 that includes an acoustic transmitter 104 and an acoustic sensor 112 mounted on a piece of tubing 102. One skilled in the art will understand that acoustic sensor 112 is configured to receive signals from a distant acoustic transmitter, and that acoustic transmitter 104 is configured to transmit to a distant acoustic sensor. Consequently, although the transmitter 104 and sensor 112 are shown in close proximity, they would only be so proximate in a repeater module 32 or in a bi-directional communications system. Thus, for example, transmitter 28 might only include the transmitter 104, while receiver 30 might only include sensor 112, if so desired.

The following discussion centers on acoustic signaling from a transmitter 28 near the drill bit 14 to a sensor located some distance away along the drill string. Various acoustic transmitters are known in the art, as evidenced by U.S. Pat. Nos. 2,810,546, 3,588,804, 3,790,930, 3,813,656, 4,282,588, 4,283,779, 4,302,826, and 4,314,365, which are hereby incorporated by reference. The transmitter 104 shown in FIG. 2 has a stack of piezoelectric washers 106 sandwiched between two metal flanges 108, 110. When the stack of piezoelectric washers 106 is driven electrically, the stack 106 expands and contracts to produce axial compression waves in tubing 102 that propagate axially along the drill string. Other transmitter configurations may be used to produce torsional waves, radial compression waves, or even transverse waves that propagate along the drill string.

Various acoustic sensors are known in the art including pressure, velocity, and acceleration sensors. Sensor 112 preferably comprises a two-axis accelerometer that senses accelerations along the axial and circumferential directions. One skilled in the art will readily recognize that other sensor configurations are also possible. For example, sensor 112 may comprise a three-axis accelerometer that also detects acceleration in the radial direction. A second sensor 114 may be provided 90 or 180 degrees away from the first sensor 112. This second sensor 114 also preferably comprises a two or three axis accelerometer. Additional sensors may also be employed as needed.

A reason for employing multiple sensors stems from an improved ability to isolate and detect a single acoustic wave propagation mode to the exclusion of other propagation modes. Thus, for example, a multi-sensor configuration may exhibit improved detection of axial compression waves to the exclusion of torsional waves, and conversely, may exhibit improved detection of torsional waves to the exclusion of axial compression waves.

Referring now to FIG. 3, an exemplary acoustic telemetry receiver 30 preferably comprises a sensor array 202, combining circuitry 106, filtering and analog-to-digital conversion circuitry 208, noise cancellation circuitry 210, and a demodulation/detection module 212. Sensor array 202 includes sensor 112 and any additional sensors in a multiple sensor configuration. Signals from. each of the sensors are buffered by amplifiers 204 and, in multiple sensor configurations, combined by combining circuitry 206 to isolate the modes of interest.

Of particular interest to the present disclosure are the measurement signals for axial compression waves and torsional waves, although other modes may alternatively be deemed of particular interest to appropriate drill string configurations. Accordingly, if a single, two-axis accelerometer is employed, the signals of interest are provided by the axial and circumferential acceleration measurements of the single accelerometer, and no combining circuitry is used. If a pair of two-axis accelerometers is employed, the axial and circumferential measurements of each are added to the corresponding measurements of the other by combining circuitry 206. If a pair of three-axis accelerometers is employed (as shown in FIGS. 6A and 6B), the combining circuitry 206 adds the axial accelerations ($Y_1$ and $Y_2$) to produce an axial signal, adds the circumferential accelerations ($X_1$ and $X_2$) to produce a circumferential signal, and combines radial and circumferential accelerations ($-Z_1$ with $X_2$, and $X_1$ with $Z_2$) to produce transverse signals. Combining circuitry 206 may combine signals from additional sensors to detect other acoustic modes and to improve isolation between mode measurements.

The acoustic noise produced by the action of the drill bit in particular and the drilling process in general is propagated up the drill string in all the acoustic wave propagation modes. The transmitter 104 is preferably configured to transmit telemetry information in a single primary acoustic wave propagation mode. It is noted that because they have the same source, the noise in one propagation mode is correlated with noise in the other propagation mode. Noise in one mode can be used to determine the noise in another mode so that this noise can be removed if desired. Other acoustic wave propagation modes provide reference signals that indicate the noise corrupting the acoustic telemetry signal. Once the noise is known, it can be removed from the mode carrying the telemetry signal.

The various wave mode measurement signals (axial, torsional, etc.) are filtered and preferably converted into digital signals in module 208. The axial signal preferably includes the telemetry signal, and the other signals are reference signals from which the in-band noise can be determined. The filtering operation eliminates signal energy outside the frequency bands of interest.

Functional module 210 receives the filtered (and preferably digital) signals and uses the filtered reference signals to remove corruption from the primary, information-carrying, filtered signal. The corrected output signal is then provided to a demodulation/detection module 212 that extracts the transmitted information.

Figure 4:
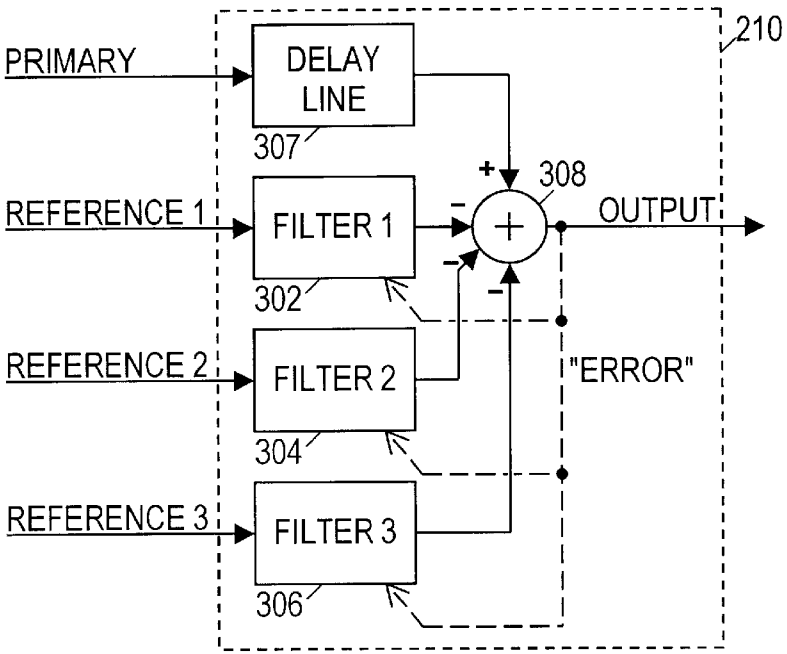
FIG. 4 is a functional block diagram of a noise cancellation embodiment.

Referring now to FIGS. 3 and 4, the noise canceling module 210 preferably includes an estimation filter 302–306 for processing each of the reference signals, and a delay element 307 for delaying the primary signal for a predetermined time. The filters 302–306 produce corruption estimates that are subtracted from the delayed primary signal by summation node 308. The output of summation node 308 is the corrected output signal.

Figure 5:
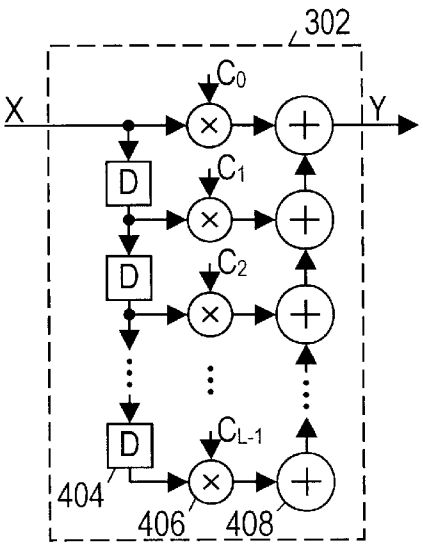
FIG. 5 is a functional block diagram of a transverse filter.

Although the filters 302–306 may be of various types, they are preferably adaptive transverse filters, i.e. "moving average" filters with adaptive coefficients. One transverse filter embodiment is shown, for example, in FIG. 5. The incoming signal X passes through a sequence of delay elements 404. The signals provided by delay elements 404, along with the original input signal X, are each multiplied by a corresponding filter coefficient $C_i$ by multipliers 406. Adders 408 sum the multipliers' products to produce an output signal Y.

Modeling of acoustic wave propagation in drill strings indicates that a telemetry signal generated in the axial transmission mode will remain in the axial mode. Very little coupling occurs into the torsional or flexural transmission modes as long as the bending radius of the pipe is greater than approximately 6 meters (20 feet). The drilling noise created by the drill bit is expected to couple into axial, torsional, and flexural modes, and the noise in the various modes is expected to be functionally related. This functional relation can be measured, and the filters 302–306 designed accordingly. However, the functional relation is expected to be variable, and consequently adaptive filters are preferred.

Returning to FIG. 4, when filters 302–306 are adaptive, an adaptation method is used to minimize the power of a chosen error signal. The corrected signal is preferably chosen as the error signal for adapting the filter coefficients. FIG. 4 shows a primary input and three reference inputs to the noise canceling module 210. For explanatory purposes, the following discussion assumes that the primary input comprises the telemetry signal plus noise, and the reference signals consist solely of noise. Where correlation exists between the reference inputs and the noise in the primary input, this correlation can be used to reduce the noise power in the primary input. The number of reference signals used to reduce the noise power can be varied, but a single reference signal may be preferred for most applications.

The sampled primary signal can be denoted as $f(T)=s(T)+n_0(T)$, where $s(T)$ is the telemetry signal and $n_0(T)$ is the noise coupled into the primary signal transmission mode. The filter(s) operate on the sampled reference signals to produce a summed total noise estimate $n_T(T)$. The reference signals are assumed to be correlated with the noise $n_0(T)$ in the primary signal, and uncorrelated with the telemetry signal. The adaptation method is designed to minimize, on average, a squared error signal $e^2(T)=[f(T)-n_T(T)]^2$. It can be shown that minimizing this squared error signal is equivalent to minimizing the squared difference between $n_0(T)$ and $n_T(T)$. One coefficient adaptation method uses the following equation:

$$(1)\ C_i(T+1)=C_i(T)+\beta e(T)\ r(T+1i),$$

where $r(T+1-i)$ is the reference input at time $T+1-i$, $e(T)$ is the error signal, $\beta$ is an adaptation coefficient, and $C_i(T)$ is the i-th filter coefficient at time T.

It is noted that the number of filters (and number of filter coefficients) may be reduced to a single filter by first summing the reference inputs to form a single summed reference signal, and then filtering the summmed reference signal. This and other noise cancellation filter variations will be apparent to one of skill in the art, and are intended to be included within the scope of the invention.

It is further noted that acoustic signaling may be performed in both directions, uphole and downhole. Repeaters may also be included along the drill string to extend the signaling range. In the preferred embodiment no more than one acoustic transmitter will be operating at any given time. The disclosed noise cancellation strategy is expected to be most advantageous for acoustic receivers located near the drill bit, as well as for acoustic receivers "listening" to a transmitter located near the drill bit. However, improved system performance is expected from the use of noise cancellation by all the receivers in the system. It is further noted that the disclosed acoustic telemetry system may operate through continuous (coiled) tubing as well as threaded tubing, and can be employed for both MWD and LWD systems.

Numerous variations and modifications will become apparent to those skilled in the art once the above disclosure is fully appreciated. It is intended that the following claims be interpreted to embrace all such variations and modifications.

What is claimed is:

1. An acoustic telemetry system comprising:

a transmitter configured to induce an acoustic information signal that propagates along a tubing string in a first propagation mode, wherein the acoustic information signal becomes corrupted during the propagation; and a signal receiver that includes sensors configured to measure a first propagation mode signal indicative of the corrupted acoustic information signal, wherein the sensors are further configured to measure a second propagation mode signal indicative of corruption present in the first propagation mode signal, wherein the signal receiver operates on the first and second propagation mode signals to produce a third signal indicative of the acoustic information signal and having reduced corruption relative to the first propagation mode signal.

2. The acoustic telemetry system of claim 1, wherein the signal receiver further includes:

a filter coupled to receive the second propagation mode signal and configured to responsively produce a corruption signal; and a summing element coupled to receive the first propagation mode signal and configured to subtract the corruption signal to produce the third signal having reduced corruption.

3. The acoustic telemetry system of claim 2, wherein the filter is an adaptive filter having coefficients that are periodically modified to reduce corruption in the third signal.

4. The acoustic telemetry system of claim 1, wherein the sensors include two accelerometers coupled to the tubing string.

5. The acoustic telemetry system of claim 4, wherein one of said two accelerometers is configured to detect axial acoustic waves in the tubing string, and wherein a second of said two accelerometers is configured to detect torsional acoustic waves in the tubing string.

6. The acoustic telemetry system of claim 1, wherein the tubing string comprises threaded tubing.

7. The acoustic telemetry system of claim 1, wherein the tubing string comprises coiled tubing.

8. The acoustic telemetry system of claim 1, wherein the transmitter comprises a piezoelectric stack configured to generate axial acoustic waves in the tubing string.

9. The acoustic telemetry system of claim 1, wherein the transmitter and signal receiver are included in a repeater that is configured to receive the corrupted acoustic signal, to reduce the corruption to substantially reproduce the acoustic information signal, and to retransmit the reproduced acoustic information signal.

10. The acoustic telemetry system of claim 1, wherein the acoustic information signal propagates along the tubing string primarily in an axial mode.

11. The acoustic telemetry system of claim 1, wherein the acoustic information signal propagates along the tubing string primarily in a torsional mode.

12. The acoustic telemetry system of claim 2, wherein the corruption signal includes drilling noise.

13. A method of logging while drilling that comprises:

generating an information-carrying acoustic signal that propagates along a drill string;

measuring a first acoustic signal propagating along the drill string in a first mode;

measuring a second acoustic signal propagating along the drill string in a second mode;

filtering the measurement of the second signal to produce an estimate of corruption in the measurement of the first acoustic signal; and subtracting the estimate from the measurement of the first acoustic signal to produce a reduced-corruption signal.

14. The method of claim 13, further comprising:

demodulating the reduced corruption signal to determine information carried by the information-carrying signal.

15. The method of claim 13, wherein the first acoustic signal propagates axially along the drill string, and wherein the second acoustic signal propagates torsionally along the drill string.

16. An acoustic telemetry receiver for operating in the presence of drilling noise, wherein the receiver comprises:

a first sensor configured to detect acoustic waves that propagates in a primary information transmission mode via a drill string;

a second sensor configured to detect acoustic waves that propagates in a second distinct transmission mode via the drill string;

a noise cancellation module coupled to the first and second sensors and configured to convert a signal from the second sensor into a noise estimate signal, wherein the noise cancellation module is further configured to subtract the noise estimate signal from a signal from the first sensor to produce an information signal.

17. The acoustic telemetry receiver of claim 16, wherein the primary information transmission mode is an axial propagation mode, and wherein the second distinct transmission mode is a torsional propagation mode.

18.The acoustic telemetry receiver of claim 16, wherein the primary information transmission mode is a torsional mode, and wherein the second distinct transmission mode is an axial propagation mode.

* * * * *